US011646044B2

(12) United States Patent
Daido et al.

(10) Patent No.: US 11,646,044 B2
(45) Date of Patent: May 9, 2023

(54) SOUND PROCESSING METHOD, SOUND PROCESSING APPARATUS, AND RECORDING MEDIUM

(71) Applicant: YAMAHA CORPORATION, Hamamatsu (JP)

(72) Inventors: Ryunosuke Daido, Hamamatsu (JP); Hiraku Kayama, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 290 days.

(21) Appl. No.: 17/014,312

(22) Filed: Sep. 8, 2020

(65) Prior Publication Data

US 2020/0402525 A1 Dec. 24, 2020

Related U.S. Application Data

(63) Continuation of application No. PCT/JP2019/009220, filed on Mar. 8, 2019.

(30) Foreign Application Priority Data

Mar. 9, 2018 (JP) ..... JP2018-043116

(51) Int. Cl.
*G10L 21/01* (2013.01)
*G10L 13/033* (2013.01)

(52) U.S. Cl.
CPC ..... *G10L 21/01* (2013.01); *G10L 13/033* (2013.01)

(58) Field of Classification Search
None
See application file for complete search history.

(56) References Cited

U.S. PATENT DOCUMENTS 9,159,329 B1 * 10/2015 Agiomyrgiannakis ..... G10L 13/06
2010/0049522 A1 * 2/2010 Tamura ..... G10L 13/033 704/E13.007

(Continued)

FOREIGN PATENT DOCUMENTS

AU 2016204672 A1 * 7/2016 ..... G10L 19/18
CA 2984936 A1 * 8/2012 ..... G10L 19/00

(Continued)

OTHER PUBLICATIONS

International Search Report issued in Intl. Appln. No. PCT/JP2019/009220 dated May 28, 2019. English translation provided.

(Continued)

*Primary Examiner* — Anne L Thomas-Homescu
(74) *Attorney, Agent, or Firm* — Rossi, Kimms & McDowell LLP

(57) ABSTRACT

A method obtains a first sound signal representative of a first sound, including a first spectrum envelope contour and a first reference spectrum envelope contour; obtains a second sound signal, representative of a second sound differing in sound characteristics from the first sound, including a second spectrum envelope contour and a second reference spectrum envelope contour; generates a synthesis spectrum envelope contour by transforming the first spectrum envelope contour based on a first difference between the first spectrum envelope contour and the first reference spectrum envelope contour at a first time point of the first sound signal, and a second difference between the second spectrum envelope contour and the second reference spectrum envelope contour at a second time point of the second sound signal; and generates a third sound signal representative of the first sound that has been transformed using the generated synthesis spectrum envelope contour.

15 Claims, 8 Drawing Sheets

(56) References Cited

U.S. PATENT DOCUMENTS

| | | | | |
|---|---|---|---|---|
| 2014/0006018 | A1* | 1/2014 | Bonada | G10L 19/265 704/208 |
| 2018/0350382 | A1* | 12/2018 | Bullough | G10L 21/0232 |

FOREIGN PATENT DOCUMENTS

| | | | | | |
|---|---|---|---|---|---|
| CN | 1174457 | A | * | 2/1998 | G10L 19/012 |
| CN | 104978970 | A | * | 10/2015 | G10L 19/012 |
| CN | 109952609 | A | * | 6/2019 | G10L 13/00 |
| JP | 2014002338 | A | * | 1/2014 | G10L 19/265 |
| JP | 2014002338 | A | | 1/2014 | |
| JP | 2017203963 | A | * | 11/2017 | |
| KR | 100351590 | B1 | * | 9/2002 | |
| WO | WO-2018003849 | A1 | * | 1/2018 | G10L 13/033 |
| WO | WO-2018084305 | A1 | * | 5/2018 | G10H 1/0008 |

OTHER PUBLICATIONS

Written Opinion issued in Intl. Appln. No. PCT/JP2019/009220 dated May 28, 2019.

* cited by examiner

SOUND PROCESSING METHOD, SOUND PROCESSING APPARATUS, AND RECORDING MEDIUM

CROSS REFERENCE TO RELATED APPLICATIONS

This application is a Continuation Application of PCT Application No. PCT/JP2019/009220, filed Mar. 8, 2019, and is based on and claims priority from Japanese Patent Application No. 2018-043116, filed Mar. 9, 2018, the entire contents of each of which are incorporated herein by reference.

BACKGROUND

Technical Field

The present disclosure relates to a technique for processing a sound signal representative of a sound.

Background Information

There are known in the art a variety of techniques for imparting sound expressions, such as singing expressions, to a voice. For example, Japanese Patent Application Laid-Open Publication No. 2014-2338 (hereafter, Patent Document 1) discloses moving harmonic components of a voice signal in a frequency domain to convert a voice represented by the voice signal into a voice having distinct voice features, such as gravelliness and huskiness.

The technique disclosed in Patent Document 1 may further be improved with respect to generating natural audible sounds.

SUMMARY

In view of the above circumstances, it is thus an object of the present disclosure to synthesize natural audible sounds.

In one aspect, a sound processing method obtains a first sound signal representative of a first sound, the first sound signal including a first spectrum envelope contour and a first reference spectrum envelope contour; obtains a second sound signal representative of a second sound differing in sound characteristics from the first sound, the second sound signal including a second spectrum envelope contour and a second reference spectrum envelope contour; generates a synthesis spectrum envelope contour by transforming the first spectrum envelope contour based on a first difference and a second difference; and generates a third sound signal representative of the first sound that has been transformed using the generated synthesis spectrum envelope contour. The first difference is present between the first spectrum envelope contour and the first reference spectrum envelope contour at a first time point of the first sound signal, and the second difference is present between the second spectrum envelope contour and the second reference spectrum envelope contour at a second time point of the second sound signal.

In another aspect, a sound processing apparatus includes a memory storing instructions; and at least one processor that implements the instructions to: obtain a first sound signal representative of a first sound, the first sound signal including a first spectrum envelope contour and a first reference spectrum envelope contour; obtain a second sound signal representative of a second sound differing in sound characteristics from the first sound, the second sound signal including a second spectrum envelope contour and a second reference spectrum envelope contour; generate a synthesis spectrum envelope contour by transforming the first spectrum envelope contour based on a first difference and a second difference; and generate a third sound signal representative of the first sound that has been transformed using the generated synthesis spectrum envelope contour. The first difference is present between the first spectrum envelope contour and the first reference spectrum envelope contour at a first time point of the first sound signal, and the second difference is present between the second spectrum envelope contour and the second reference spectrum envelope contour at a second time point of the second sound signal.

In still another aspect, a non-transitory computer-readable recording medium stores a program executable by a computer to execute a sound processing method comprising: obtaining a first sound signal representative of a first sound, the first sound signal including a first spectrum envelope contour and a first reference spectrum envelope contour; obtaining a second sound signal representative of a second sound differing in sound characteristics from the first sound, the second sound signal including a second spectrum envelope contour and a second reference spectrum envelope contour; generating a synthesis spectrum envelope contour by transforming the first spectrum envelope contour based on a first difference and a second difference; and generating a third sound signal representative of the first sound that has been transformed using the generated synthesis spectrum envelope contour. The first difference is present between the first spectrum envelope contour and the first reference spectrum envelope contour at a first time point of the first sound signal, and the second difference is present between a second spectrum envelope contour and the second reference spectrum envelope contour at a second time point of the second sound signal.

DETAILED DESCRIPTION

Figure 1:
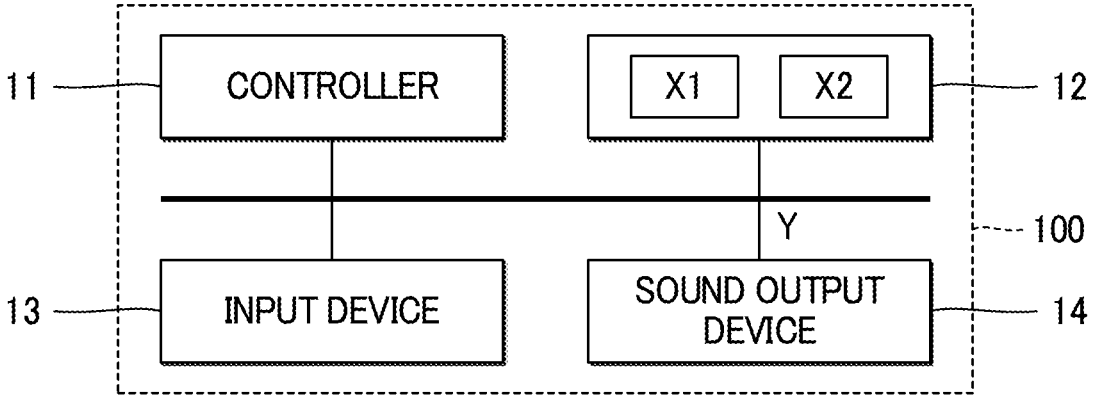
FIG. 1 is a block diagram showing a configuration of a sound processing apparatus according to an embodiment of the present disclosure.

FIG. 1 is a block diagram illustrating a configuration of a sound processing apparatus 100 according to a preferred embodiment of the present disclosure. The sound processing apparatus 100 according to the present embodiment is a signal processing apparatus configured to impart various voice expressions to a singing voice of a song sung by a user. The sound expressions are sound characteristics imparted to a singing voice (an example of a first sound). In singing a song, sound expressions are musical expressions that relate to vocalization (i.e., singing). Specifically, preferred examples of the sound expressions are singing expressions, such as vocal fry, growl, or huskiness. The sound expressions are, in other words, singing voice features.

The sound expressions are particularly pronounced during attack and release portions of a singing voice. In the attack portion, a volume increases just after singing starts. In the release portion, the volume decreases just before the singing ends. Taking into account these tendencies, in the present embodiment sound expressions are imparted to each of the attack and release portions of the singing voice.

As illustrated in FIG. 1, the sound processing apparatus 100 is realized by a computer system that includes a controller 11, a storage device 12, an input device 13, and a sound output device 14. For example, a portable information terminal such as a mobile phone or a smartphone, or a portable or stationary information terminal such as a personal computer is preferable for use as the sound processing apparatus 100. The input device 13 receives instructions provided by a user. Specifically, operators that are operable by the user or a touch panel that detects contact thereon are preferable for use as the input device 13.

The controller 11 is, for example, at least one processor, such as a CPU (Central Processing Unit), which controls a variety of computation and control processing. The controller 11 of the present embodiment generates a third sound signal Y. The third sound signal Y is representative of a voice (hereafter, "transformed sound") obtained by imparting sound expressions to a singing voice. The sound output device 14 is, for example, a loudspeaker or a headphone, and outputs a transformed sound that is represented by the third sound signal Y generated by the controller 11. A digital-to-analog converter converts the third sound signal Y generated by the controller 11 from a digital signal to an analog signal. For convenience, illustration of the digital-to-analog converter is omitted. Although the sound output device 14 is mounted to the sound processing apparatus 100 in the configuration shown in FIG. 1, the sound output device 14 may be provided separate from the sound processing apparatus 100 and connected thereto either by wire or wirelessly.

The storage device 12 is a memory constituted, for example, of a known recording medium such as a magnetic recording medium or a semiconductor recording medium, and has stored therein a computer program to be executed by the controller 11 and various types of data used by the controller 11. The storage device 12 may be constituted of a combination of different types of recording media. The storage device 12 (for example, cloud storage) may be provided separate from the sound processing apparatus 100, with the controller 11 configured to write to and read from the storage device 12 via a communication network, such as a mobile communication network or the Internet. That is, the storage device 12 may be omitted from the sound processing apparatus 100.

The storage device 12 of the present embodiment has stored therein a first sound signal X1 and a second sound signal X2. The first sound signal X1 is an audio signal representative of a singing voice of a song sung by a user of the sound processing apparatus 100. The second sound signal X2 is an audio signal representative of a singing voice, with sound expressions, of a song sung by a singer (e.g., a professional singer or trained amateur singer) other than the user (hereafter, "reference voice"). Sound expressions are imparted by the singer when singing the song. The sound characteristics (e.g., singing voice features) in the first sound signal X1 are not the same as those in the second sound signal X2. In the present embodiment, the sound processing apparatus 100 generates the third sound signal Y, which is a transformed sound, by imparting the sound expressions of a reference voice (an example of a second sound) represented by the second sound signal X2, to the singing voice represented by the first sound signal X1. The same song may or may not be used for the singing voice and the reference voice. Although the above description assumes a case in which a singer of the singing voice differs from a singer of the reference voice, the singer of the singing voice and the singer of the reference voice may be the same. For example, the singing voice may be a singing voice sung by the user without imparting any sound expressions and the reference voice may be a singing voice sung by the user while imparting sound expressions.

Figure 2:
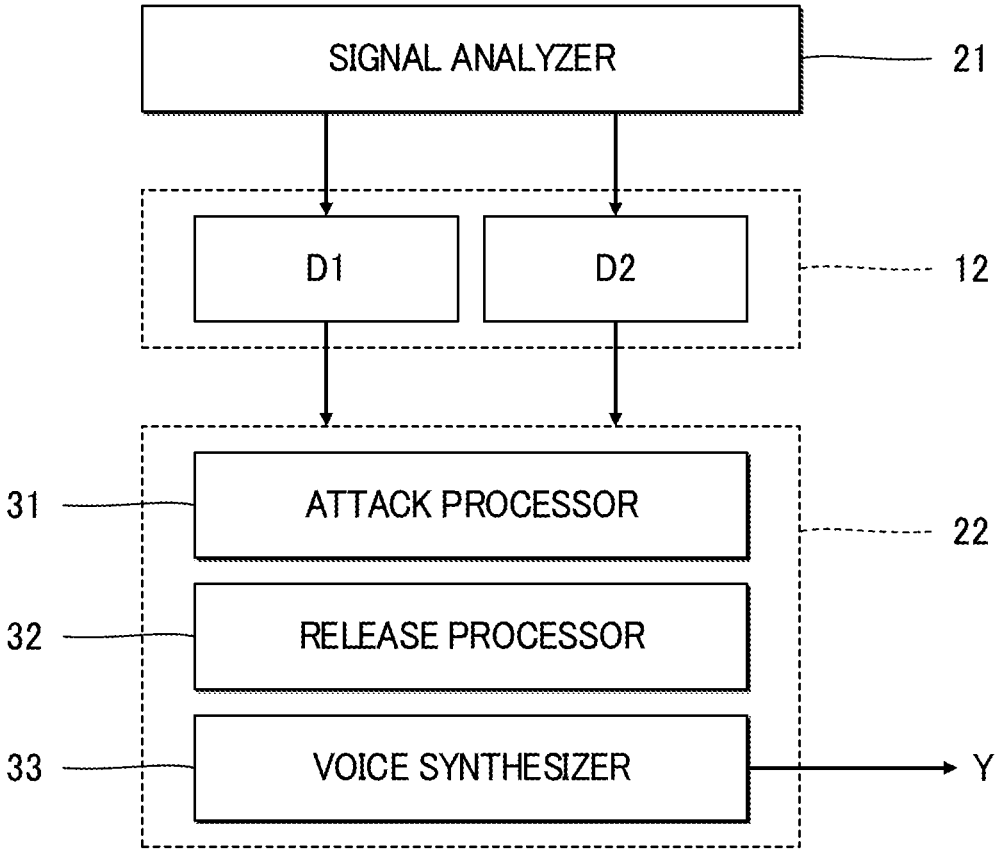
FIG. 2 is a block diagram illustrating a functional configuration of a sound processing apparatus.

FIG. 2 is a block diagram showing a functional configuration of the controller 11. As shown in FIG. 2, the controller 11 executes a computer program (i.e., a sequence of instructions for execution by a processor) stored in the storage device 12, to realize functions (a signal analyzer 21 and a synthesis processor 22) to generate a third sound signal Y based on a first sound signal X1 and a second sound signal X2. The functions of the controller 11 may be realized by multiple apparatuses provided separately. A part or all of the functions of the controller 11 may be realized by dedicated electronic circuitry.

The signal analyzer 21 generates analysis data D1 by analyzing the first sound signal X1, and generates analysis data D2 by analyzing the second sound signal X2. The analysis data D1 and the analysis data D2 generated by the signal analyzer 21 are stored in the storage device 12.

Figure 3:
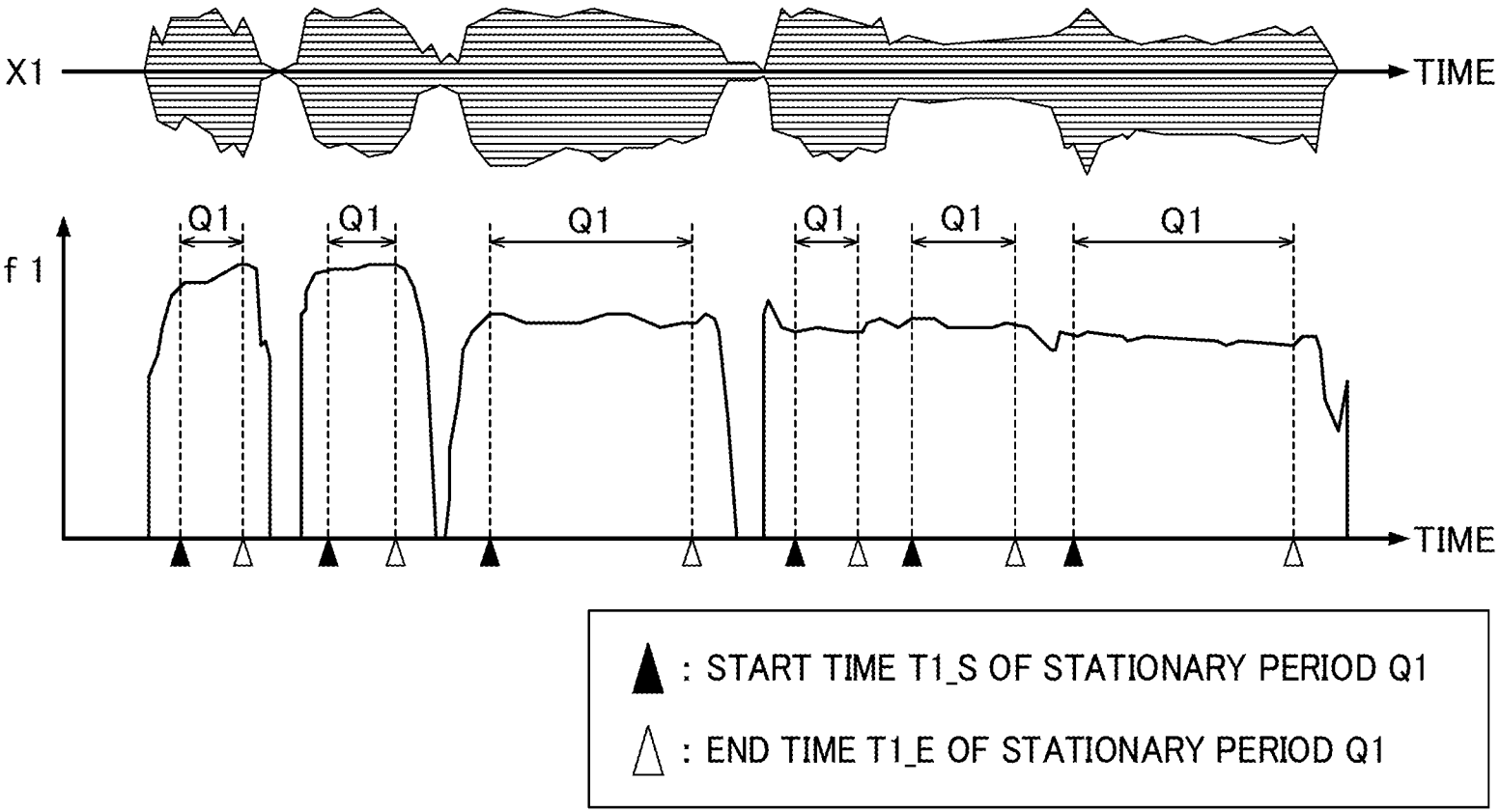
FIG. 3 is an explanatory diagram of stationary periods in a first sound signal.

The analysis data D1 are representative of stationary periods Q1 in the first sound signal X1. As shown in FIG. 3, in each of the stationary periods Q1 of the analysis data D1, the fundamental frequency f1 and the spectrum shape are temporally steady in the first sound signal X1. The stationary periods Q1 have variable length. The analysis data D1 designate a time point T1_S indicative of a start point of each stationary period Q1 (hereafter, "start time"), and a time point T1_E indicative of an end point of each stationary period Q1 (hereafter, "end time"). It is of note that the fundamental frequency f1 or the spectrum shape (i.e., phonemes) often change between two consecutive notes in a song. Thus, each stationary period Q1 is likely to correspond to a single note in a song.

Similarly, the analysis data D2 are representative of stationary periods Q2 in the second sound signal X2. Each stationary period Q2 has a variable length, and the fundamental frequency f2 and the spectrum shape are temporally steady in the second sound signal X2 in each stationary period Q2. The analysis data D2 designate a start time T2_S and an end time T2_E of each stationary period Q2. Similarly to the stationary period Q1, each stationary period Q2 is likely to correspond to a single note in a song.

Figure 4:
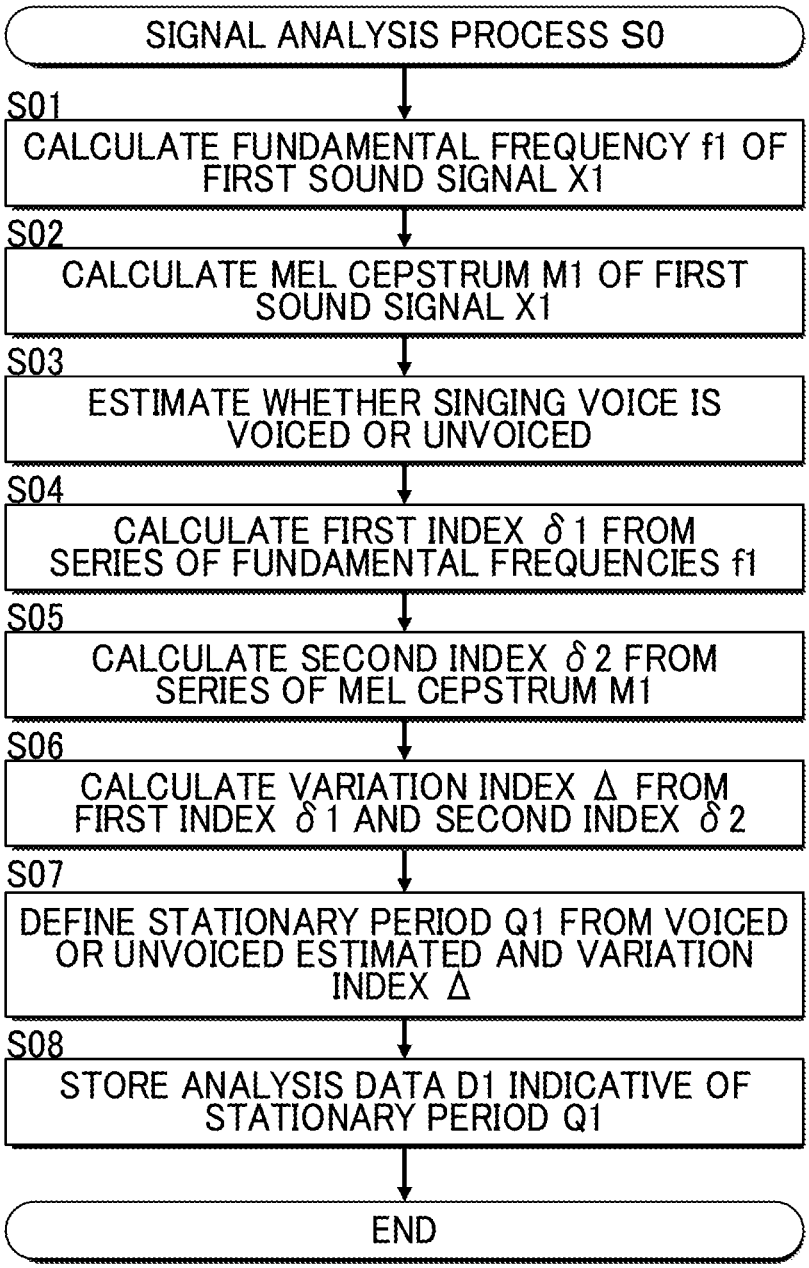
FIG. 4 is a flowchart illustrating specific procedures of a signal analysis process.

FIG. 4 is a flowchart illustrating a signal analysis process S0 for analyzing the first sound signal X1 by the signal analyzer 21. For example, the signal analysis process S0 in FIG. 4 is initiated by a user instruction input to the input device 13 acting as a trigger. As shown in FIG. 4, the signal analyzer 21 calculates a fundamental frequency f1 of the first sound signal X1 for each of unit periods (frames) on a time axis (S01). A suitable known technique can be freely adopted to calculate the fundamental frequency f1. Each unit period is of a sufficiently shorter duration than a duration assumed to be that of each stationary period Q1.

The signal analyzer 21 calculates for each unit period a Mel Cepstrum M1 representative of a spectrum shape of the first sound signal X1 (S02). The Mel Cepstrum M1 is expressed by coefficients representative of a frequency spectrum of the first sound signal X1. The Mel Cepstrum M1 can also be expressed as characteristics representative of phonemes of the singing voice. A suitable known technique can also be freely adopted to calculate the Mel Cepstrum M1. Further, Mel-Frequency Cepstrum Coefficients (MFCC) may be calculated and serve as characteristics representative of a spectrum shape of the first sound signal X1 instead of the Mel Cepstrum M1.

For each unit period, the signal analyzer 21 estimates whether a singing voice represented by the first sound signal X1 is voiced or unvoiced (S03). In other words, determination is made of whether the singing voice is a voiced sound or an unvoiced sound. A suitable known technique can be freely adopted for estimation of a voiced/unvoiced sound. The step of calculating the fundamental frequency f1 (S01), the step of calculating the Mel Cepstrum M1 (S02), and a voiced/unvoiced estimation (S03) need not necessarily be performed in the above-described order, and may be performed in a freely selected order.

For each unit period, the signal analyzer 21 calculates a first index M indicative of a degree of a temporal change in the fundamental frequency f1 (S04). The first calculated index M is, for example, a difference in the fundamental frequency f1 between two consecutive unit periods. The first calculated index M takes a greater value since the temporal change in the fundamental frequency f1 is more prominent.

For each unit period, the signal analyzer 21 calculates a second index δ2 indicative of a degree of temporal change in the Mel Cepstrum M1 (S05). A preferred form of the second index δ2 is, for example, a value obtained by synthesizing (e.g., adding together or averaging), for each of the coefficients of the Mel Cepstrum M1, differences in coefficients between two consecutive unit periods. The second calculated index δ2 takes a greater value in the singing voice since the temporal change in spectrum shape is more prominent. For example, the second calculated index δ2 takes a greater value proximate a time point at which a phoneme of the singing voice changes.

For each unit period, the signal analyzer 21 calculates a variation index Δ based on the first index δ1 and the second index δ2 (S06). A variation index Δ calculated for each unit period may be in a form of a weighted sum of the first index M and the second index δ2. A value of each weight to be applied to the first index δ1 and the second index δ2 may be a predetermined fixed value, or may be a variable value that is set in accordance with the user's instruction input to the input device 13. As will be apparent from the above explanations, there is a tendency for the variation index Δ to take a greater value when a temporal change in the fundamental frequency f1 or the Mel Cepstrum M1 (i.e., spectrum shape) in the first sound signal X1 is greater.

The signal analyzer 21 specifies stationary periods Q1 in the first sound signal X1 (S07). The signal analyzer 21 of the present embodiment specifies stationary periods Q1 based on results of the voiced/unvoiced estimation (S03) and the variation indices Δ. Specifically, the signal analyzer 21 defines a group of consecutive unit periods as a stationary period Q1, in a case where, for each of the consecutive unit periods, the singing voice is estimated as being a voiced sound and where the variation index Δ is below a predetermined threshold. A unit period for which the singing voice is estimated as an unvoiced sound and a unit period for which the variation index Δ exceeds the threshold are determined not to be a part of a stationary period Q1. After performing the above-described procedure to define each stationary period Q1 in the first sound signal X1, the signal analyzer 21 stores in the storage device 12 analysis data D1 that designate a start time T1_S and an end time T1_E of each stationary period Q1 (S08).

The signal analyzer 21 also executes the above-described signal analysis process S0 for the second sound signal X2 representative of a reference voice, to generate analysis data D2. Specifically, for each unit period of the second sound signal X2 the signal analyzer 21, calculates the fundamental frequency F2 (S01), calculates the Mel Cepstrum M2 (S02), and estimates whether the reference voice is voiced/unvoiced (S03). The signal analyzer 21 calculates a first index M indicative of a degree of temporal changes in the fundamental frequency F2 and a second index δ2 indicative of a degree of temporal changes in the Mel Cepstrum M2, and then calculates a variation index Δ based on the first index M and the second index δ2 (S04-S06). The signal analyzer 21 subsequently determines each stationary period Q2 of the second sound signal X2 based on an estimation result of whether the reference voice is voiced/unvoiced (S03), and the variation index Δ (S07). The signal analyzer 21 stores in the storage device 12 analysis data D2 that designate a start time T2_S and an end time T2_E of each stationary period Q2 (S08). The analysis data D1 and the analysis data D2 may be set in accordance with the user's instructions by way of the input device 13. Specifically, analysis data D1 that designate a start time T1_S and an end time T1_E as instructed by the user and analysis data D2 that designate a start time T2_S and an end time T2_E as instructed by the user are stored in the storage device 12. Thus, the signal analysis process S0 need not necessarily be performed.

Using the analysis data D2 of the second sound signal X2, the synthesis processor 22 of FIG. 2 transforms the analysis data D1 of the first sound signal X1. The synthesis processor 22 of the present embodiment includes an attack processor 31, a release processor 32, and a voice synthesizer 33. The attack processor 31 executes an attack process S1 of imparting to the first sound signal X1 sound expressions in an attack portion of the second sound signal X2. The release processor 32 executes a release process S2 of imparting to the first sound signal X1 sound expressions in a release portion of the second sound signal X2. Based on results of the processes executed by the attack processor 31 and the release processor 32, the voice synthesizer 33 synthesizes the third sound signal Y, which is a transformed sound.

Figure 5:
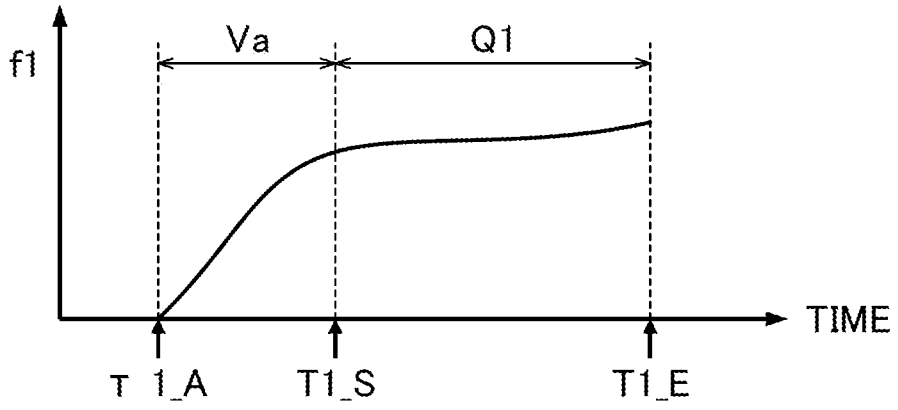
FIG. 5 shows temporal changes in fundamental frequency immediately before utterance of a singing voice starts.

FIG. 5 shows temporal changes in the fundamental frequency f1 in a period immediately after the utterance of the singing voice starts. As shown in FIG. 5, a voiced period Va exists immediately before the stationary period Q1. The voiced period Va is a voiced period that precedes the stationary period Q1. The voiced period Va is a period in which sound characteristics (e.g., fundamental frequency f1 or spectrum shape) of the singing voice vary unstably immediately before the stationary period Q1. As an example, focusing on a stationary period Q1 that exists immediately after the utterance of the singing voice starts, the voiced period Va corresponds to an attack portion from a time τ1_A at which the utterance of the singing voice starts, to the start time τ1_S of the stationary period Q1. It is of note that, although the above description focuses on the singing voice, the same applies to the reference voice. That is, a voiced period Va exists immediately before a stationary period Q2 in the reference voice. In the attack process S1, the synthesis processor 22 (namely, the attack processor 31) imparts sound expressions of the attack portion in the second sound signal X2 to the voiced period Va and a stationary period Q1 that immediately follows the voiced period Va in the first sound signal X1.

Figure 6:
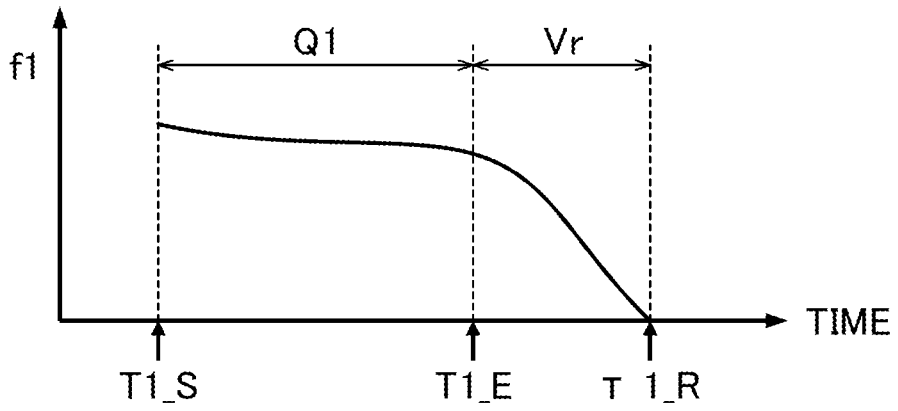
FIG. 6 shows temporal changes in fundamental frequency immediately before utterance of a singing voice ends.

FIG. 6 shows temporal changes in the fundamental frequency f1 in a period immediately before the utterance of the singing voice ends. As shown in FIG. 6, a voiced period Vr exists immediately after the stationary period Q1. The voiced period Vr is a voiced period subsequent to the stationary period Q1. The voiced period Vr is a period in which sound characteristics (e.g., fundamental frequency F2 or spectrum shape) of the singing voice vary unstably immediately after the stationary period Q1.

For example, focusing on a stationary period Q1 that exists immediately before the utterance of the singing voice ends, the voiced period Vr corresponds to a release portion from an end time T1_E of the stationary period Q1 to a time τ1_R at which the singing voice ends sounding. It is of note that, although the above description focuses on the singing voice, the same applies to the reference voice. That is, a voiced period Vr exists immediately after a stationary period Q2 in the reference voice. In the release process S2, the synthesis processor 22 (namely, the release processor 32) imparts sound expressions of the release portion of the second sound signal X2 to a voiced period Vr and a stationary period Q1 that immediately precedes the voiced period Vr in the first sound signal X1.

Release Process S2

Figure 7:
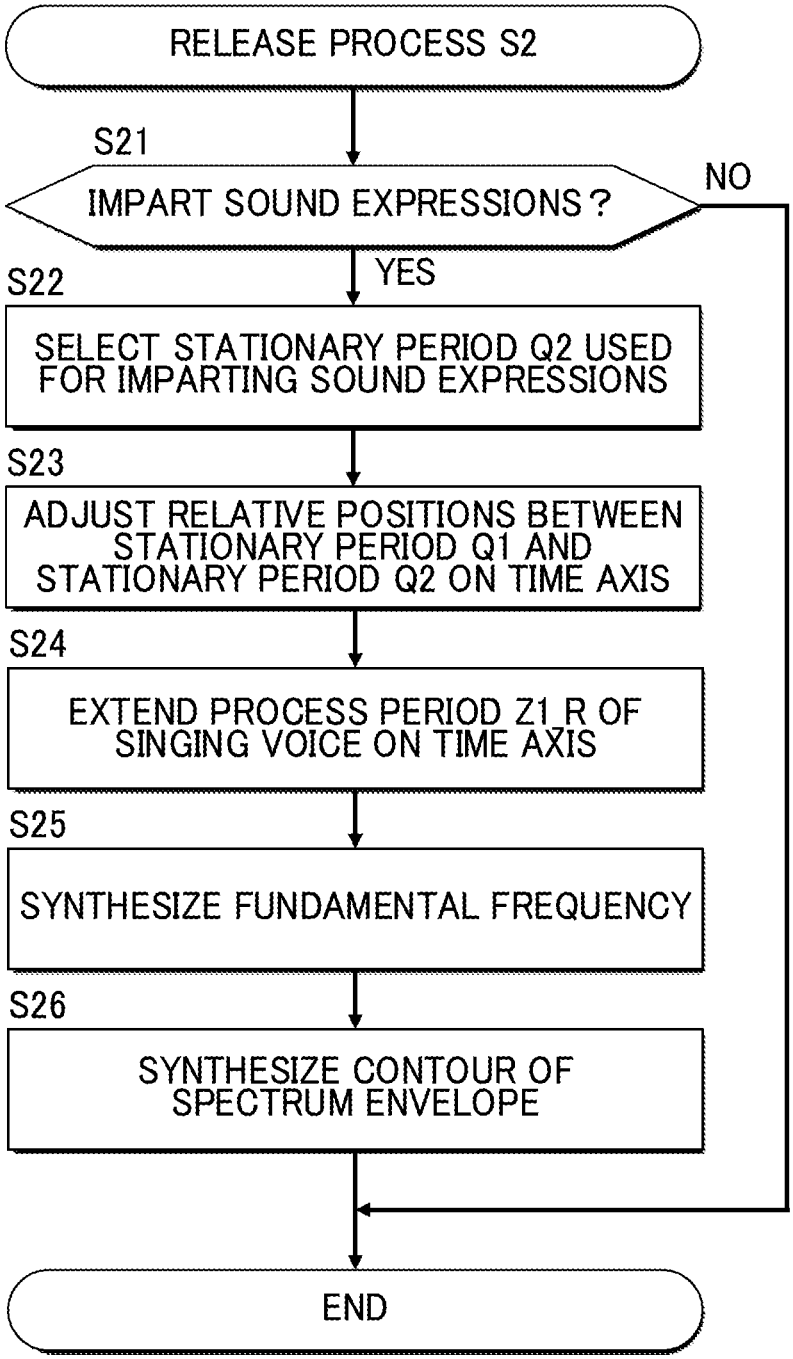
FIG. 7 is a flowchart illustrating specific procedures of a release process.

FIG. 7 is a flowchart illustrating a specific flow of the release process S2 executed by the release processor 32. The release process S2 of FIG. 7 is executed for each stationary period Q1 of the first sound signal X1.

When the release process S2 starts, the release processor 32 determines whether to impart sound expressions of a release portion in the second sound signal X2 to the subject stationary period Q1 in the first sound signal X1 (S21). Specifically, the release processor 32 determines not to impart sound expressions of a release portion if the stationary period Q1 satisfies any one of the following conditions Cr1 to Cr3, for example. It is of note that the conditions for determining whether to impart sound expressions to the stationary period Q1 of the first sound signal X1 are not limited to the following examples.

Condition Cr1: a length of the stationary period Q1 is less than a predetermined value;

Condition Cr2: a length of an unvoiced period that immediately follows the stationary period Q1 is less than a predetermined value; and Condition Cr3: a length of a voiced period Vr that is subsequent to the stationary period Q1 exceeds a predetermined value.

It is difficult to impart sound expressions with natural voice features to a stationary period Q1 that is sufficiently short. Accordingly, if a length of the stationary period Q1 is less than a predetermined value (Condition Cr1), the release processor 32 excludes such a stationary period Q1 from those to which sound expressions are to be imparted. In a case where a sufficiently short unvoiced period exists immediately after the stationary period Q1, this unvoiced period is likely to be an unvoiced consonant period mid-way through the singing voice. Listeners tend to experience auditory discomfort if sound expressions are imparted to an unvoiced consonant period. Accordingly, if a length of an unvoiced period that immediately follows the stationary period Q1 is less than a predetermined value (Condition Cr2), the release processor 32 excludes such a stationary period Q1 from those to which sound expressions are to be imparted. Further, in a case where a length of a voiced period Vr that immediately follows the stationary period Q1 is sufficiently long, it is likely that sufficient sound expressions have already been imparted to the singing voice. Therefore, if a length of a voiced period Vr subsequent to the stationary period Q1 is sufficiently long (Condition Cr3), the release processor 32 excludes such a stationary period Q1 from those to which sound expressions are imparted. In a case that the release processor 32 determines not to impart sound expressions to the stationary period Q1 of the first sound signal X1 (S21: NO), the release processor 32 ends the release process S2 without executing the processes (S22-S26), which processes are described below in detail.

In a case that the release processor 32 determines to impart sound expressions of a release portion of the second sound signal X2 to the stationary period Q1 of the first sound signal X1 (S21: YES), the release processor 32 selects a stationary period Q2 that corresponds to the sound expressions to be imparted to the first sound signal X1, from among the stationary periods Q2 of the second sound signal X2 (S22). Specifically, the release processor 32 selects a stationary period Q2 that is contextually similar to the subject stationary period Q1 within a song. Given as examples of types of contexts to be considered for a stationary period (hereafter, "stationary period of focus") there are included a length of the stationary period of focus, a length of a stationary period that immediately follows the stationary period of focus, a pitch difference between the stationary period of focus and the immediately subsequent stationary period, a pitch of the stationary period of focus, and a length of an unvoiced period that immediately precedes the stationary period of focus. The release processor 32 selects a stationary period Q2 that differs least from the stationary period Q1 for the contexts given above as examples.

Figure 8:
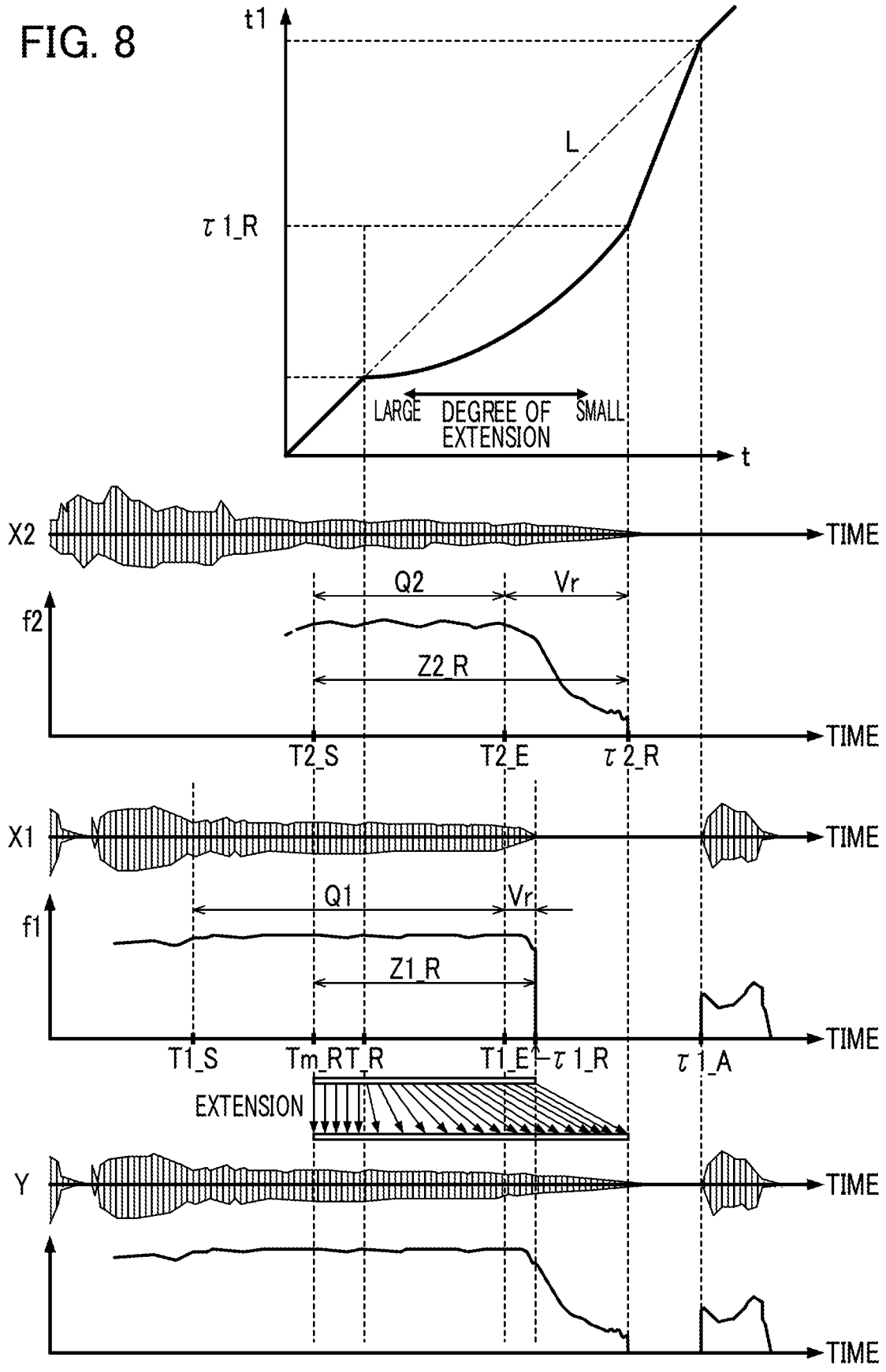
FIG. 8 is an explanatory diagram of the release process.

The release processor 32 executes processes (S23-S26) for imparting, to the first sound signal X1 (analysis data D1), sound expressions in the stationary period Q2 selected in accordance with the above procedure. FIG. 8 is an explanatory diagram of a process performed by the release processor 32 of imparting sound expressions of a release portion to the first sound signal X1.

In FIG. 8, waveforms on a time axis and temporal changes in frequency are shown for each of the first sound signal X1, the second sound signal X2, and the third sound signal Y, which has been transformed. Among the various information shown in FIG. 8, known information is a start time τ1_S and an end time τ1_E of a stationary period Q1 in the singing voice; an end time τ1_R of a voiced period Vr that immediately follows the stationary period Q1; a start time τ1_A of a voiced period Va corresponding to a note that immediately follows the stationary period Q1; a start time τ2_S and an end time τ2_E of a stationary period Q2 in the reference voice; and an end time τ2_R of a voiced period Vr that immediately follows the stationary period Q2.

The release processor 32 adjusts relative positions between the stationary period Q1 to be processed and the stationary period Q2 selected in Step S22 on a time axis (S23). Specifically, the release processor 32 adjusts a time axial position of the stationary period Q2 relative to an end point (T1_S or T1_E) of the stationary period Q1. As shown in FIG. 8, the release processor 32 of the present embodiment determines a time axial position of the second sound signal X2 (stationary period Q2) relative to the first sound signal X1 such that the end time τ2_E of the stationary period Q2 matches the end time τ1_E of the stationary period Q1 on the time axis.

Extension of Process Period Z1_R (S24)

The release processor 32 extends or contracts on the time axis a part Z1_R of the first sound signal X1, to which part the sound expressions of the second sound signal X2 are imparted (hereafter, "process period") (S24). As shown in FIG. 8, the process period Z1_R is from a time point Tm_R at which impartation of the sound expressions starts (hereafter, "synthesis start time") until the end time τ1_R of the voiced period Vr, which immediately follows the stationary period Q1. The synthesis start time Tm_R is the start time τ1_S of the stationary period Q1 in the singing voice or the start time τ2_S of the stationary period Q2 in the reference voice, whichever is later. As shown in FIG. 8, where the start time τ2_S of the stationary period Q2 is later than the start time τ1_S of the stationary period Q1, the start time τ2_S of the stationary period Q2 is determined to be the synthesis start time Tm_R. However, the synthesis start time Tm_R is not limited to the start time τ2_S.

As shown in FIG. 8, the release processor 32 of the present embodiment extends the process period Z1_R of the first sound signal X1 dependent on a duration of an expression period Z2_R of the second sound signal X2. The sound in the expression period Z2_R represents sound expressions of a release portion of the second sound signal X2, and the sound expressions in the expression period Z2_R are imparted to the first sound signal X1. As shown in FIG. 8, the expression period Z2_R is from the synthesis start time Tm_R until the end time τ2_R of the voiced period Vr, which immediately follows the stationary period Q2.

A reference voice is sung by a skilled singer such as a professional singer or trained amateur singer, and hence sound expressions commensurate with the singer's skill are likely be present over a duration of the reference voice. In contrast, a singing voice is sung by a user who is not a skilled singer and hence such sound expressions are not likely to be present over a duration of the singing voice. As shown in FIG. 8, these tendencies are reflected in that an expression period Z2_R of a reference voice has a longer duration than a process period Z1_R of the singing voice. Accordingly, the release processor 32 of the present embodiment extends the process period Z1_R of the first sound signal X1 to match the duration of the expression period Z2_R of the second sound signal X2.

The process period Z1_R is extended through a mapping process in which a freely-selected time t1 of the first sound signal X1 (singing voice) is matched to correspond to a freely-selected time t of the third sound signal Y transformed (transformed sound). FIG. 8 shows a correspondence between the time t1 of the singing voice (vertical axis) and the time t of the transformed sound (horizontal axis).

In the correspondence shown in FIG. 8, the time t1 of the first sound signal X1 corresponds to the time t of the transformed sound. In FIG. 8, a dash-dot reference line L denotes a state in which the first sound signal X1 is neither extended nor contracted (t1=t). In a state in which the first sound signal X1 is extended, a period of time over which the gradient of the time t1 of the singing voice relative to the time t of the transformed sound is less than that of the reference line L. In a state in which the singing voice is contracted, a period of time over which the gradient of the time t1 relative to the time t is greater than that of the reference line L.

The correspondence between the time t1 and the time t can be expressed as a non-linear function, for example as shown in the following Equations (1a) to (1c).

$$t1 = \begin{cases} t & (t < \mathrm{T_R}) \quad (1a) \\ \eta\left(\dfrac{t - \mathrm{T_R}}{\mathrm{T1_R} - \tau 2_\mathrm{R}}\right)(\mathrm{T1_R} - \mathrm{T_R}) + \mathrm{T_R} & (\mathrm{T_R} \le t < \tau 2_\mathrm{R}) \quad (1b) \\ \dfrac{t - \tau 2_\mathrm{R}}{\mathrm{T1_R} - \tau 2_\mathrm{R}}(\tau 1_\mathrm{A} - \tau 1_\mathrm{R}) + \tau 1_\mathrm{R} & (\tau 2_\mathrm{R} \le t < \tau 1_\mathrm{A}) \quad (1c) \end{cases}$$

Here, the time T_R is, as shown in FIG. 8, a given time between the synthesis start time Tm_R and the end time τ1_R of the process period Z1_R. For example, (i) a midpoint between the start time T1_S and the end time T1_E of the stationary period Q1 ((T1_S+T1_E)/2) or (ii) the synthesis start time Tm_R, whichever is later, is determined to be the time T_R. As will be understood from Equation (1a), in the process period Z1_R, a period of time that precedes the time T_R is neither extended nor contracted. Thus, the process period Z1_R starts to extend from the time T_R.

As will be understood from Equation (1b), in the process period Z1_R a period of time that follows the time T_R is extended along a time axis such that the degree of extension is greater closer to the time T_R and lesser upon approach to the end time τ1_R. The function η(t) in Equation (1b) is a non-linear function for extending the process period Z1_R by a greater degree earlier on the time axis, and for reducing the degree of extension of the process period Z1_R later on the time axis. Specifically, the function η(t) may preferably be a quadratic function (η(t)=t2) of the time t. Thus, in the present embodiment the process period Z1_R is extended on a time axis such that a degree of extension is smaller at a temporal position that is closer to the end time τ1_R of the process period Z1_R. Accordingly, the transformed sound is able to maintain sound characteristics of the singing voice that exist proximate to the end time τ1_R. As a result, auditory discomfort resulting from the extension is less likely to be perceived at a temporal position that is proximate to the time T_R as compared to a position proximate to the end time τ1_R. Accordingly, even if the degree of extension is high at a position close to the time T_R as in the above example, the transformed sound does not sound unnatural. As will be apparent from Equation (1c), it is of note that with regard to the first sound signal X1, a period from the end time τ2_R of the expression period Z2_R until the start time τ1_A of the next voiced period Vr is shortened on the time axis. Since there is no voice in a period from the end time τ2_R until the start time τ1_A, this part of the first sound signal X1 can be deleted.

As described, the process period Z1_R of the singing voice is extended to have the same length as that of expression period Z2_R of the reference voice. On the other hand, the expression period Z2_R of the reference voice is neither extended nor contracted on a time axis. Thus, a time t2 of the second sound signal X2 matches the time t of the transferred sound (t2=t) after the second sound signal X2 is arranged to correspond to the time t of the transformed sound. As described above, in the present embodiment the process period Z1_R of the singing voice is extended dependent on the length of the expression period Z2_R, and hence, the second sound signal X2 need not be extended. Accordingly, it is possible to accurately impart to the first sound signal X1 sound expressions of a release portion represented by the second sound signal X2.

After the process period Z1_R is extended by use of the above procedure, the release processor 32 transforms, in accordance with the expression period Z2_R of the second sound signal X2, the extended process period Z1_R of the first sound signal X1 (S25-S26). Specifically, fundamental frequencies in the extended process period Z1_R of the singing voice and those in the expression period Z2_R of the reference voice are synthesized together (S25), and a spectrum envelope contour in the extended process period Z1_R is synthesized with that of the expression period Z2_R (S26).

Fundamental Frequency Synthesis (S25)

The release processor 32 calculates a fundamental frequency F(t) at each time t of the third sound signal Y by computing Equation (2).

$$F(t)=f1(t1)-\lambda1(f1(t1)-F1(t1))+\lambda2(f2(t2)-F2(t2)) \quad (2)$$

The smoothed fundamental frequency F1(t1) in Equation (2) is a frequency obtained by smoothing on a time axis a series of fundamental frequencies f1(t1) of the first sound signal X1. The smoothed fundamental frequency F2(t2) in Equation (2) is a frequency obtained by smoothing on a time axis a series of fundamental frequencies f2(t2) of the second sound signal X2. The coefficient λ1 and the coefficient λ2 in Equation (2) are each set to be as a non-negative value equal to or less than 1 ($0\leq\lambda1\leq1$, $0\leq\lambda2\leq1$).

As will be understood from Equation (2), the second term of Equation (2) corresponds to a process of subtracting from the fundamental frequency f1(t1) of the first sound signal X1 a difference between the fundamental frequency f1(t1) and the smoothed fundamental frequency F1(t1) of the singing voice by a degree that accords with the coefficient λ1. The third term of Equation (2) corresponds to a process of adding to the fundamental frequency f1(t1) of the first sound signal X1 a difference between the fundamental frequency f2(t2) and the smoothed fundamental frequency F2(t2) of the reference voice by a degree that accords with the coefficient λ2. As will be understood from the above explanations, the release processor 32 serves as an element that replaces the difference between the fundamental frequency f1(t1) and the smoothed fundamental frequency F1(t1) of the singing voice by the difference between the fundamental frequency f2(t2) and the smoothed fundamental frequency F2(t2) of the reference voice. Accordingly, a temporal change in the fundamental frequency f1(t1) in the extended process period Z1_R of the first sound signal X1 approaches a temporal change in the fundamental frequency f2(t2) in the expression period Z2_R of the second sound signal X2.

Spectrum Envelope Contour Synthesis (S26)

Figure 9:
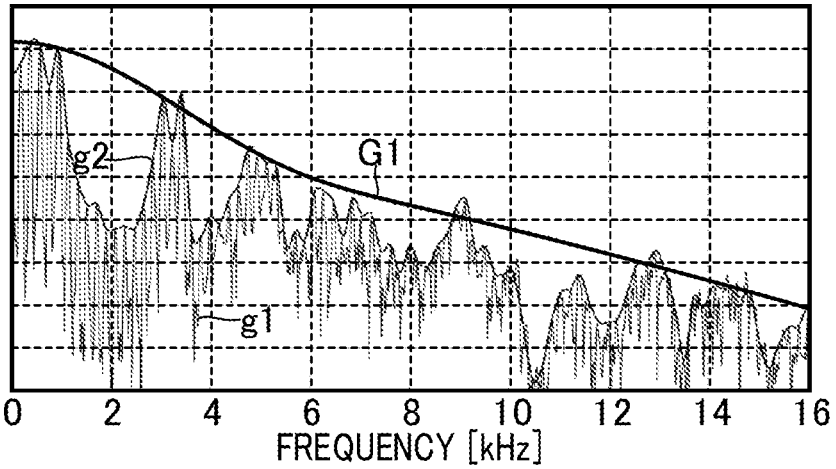
FIG. 9 is an explanatory diagram of spectrum envelope contours.

The release processor 32 synthesizes the spectrum envelope contour of the extended process period Z1_R of the singing voice with that in the expression period Z2_R of the reference voice. As shown in FIG. 9, a spectrum envelope contour G1 of the first sound signal X1 is an intensity distribution obtained by further smoothing in a frequency domain a spectrum envelope g2 that is a contour of a frequency spectrum g1 of the first sound signal X1. Specifically, the spectrum envelope contour G1 is a representation of an intensity distribution obtained by smoothing the spectrum envelope g2 to an extent that phonemic features (phoneme-dependent differences) and individual features (differences dependent on a person who produces a sound) can no longer be perceived. The spectrum envelope contour G1 may be expressed in a form of a predetermined number of lower-order coefficients of plural Mel Cepstrum coefficients representative of the spectrum envelope g2. Although the above description focuses on the spectrum envelope contour G1 of the first sound signal X1, the same is true for the spectrum envelope contour G2 of the second sound signal X2.

The release processor 32 calculates in accordance with Equation (3) a spectrum envelope contour G(t) at each time t of the third sound signal Y (hereafter, "synthesis spectrum envelope contour").

$$G(t)=G1(t1)-\mu1(G1(t1)-G1_ref)+\mu2(G2(t2)-G2_ref) \quad (3)$$

In Equation (3), G1_ref, denotes a reference spectrum envelope contour. A spectrum envelope contour G1 at a specific time point among the multiple spectrum envelope contours G1 of the first sound signal X1 serves as the reference spectrum envelope contour G1_ref (an example of a first reference spectrum envelope contour). Specifically, the reference spectrum envelope contour G1_ref is a spectrum envelope contour G1(Tm_R) at the synthesis start time Tm_R (an example of a first time point) of the first sound signal X1. The reference spectrum envelope contour G1_ref is extracted at a time point that is at the start time T1_S of the stationary period Q1 or the start time T2_S of the stationary period Q2, whichever is later. It is of note that the reference spectrum envelope contour G1_ref may be extracted at a time point other than the synthesis start time Tm_R. For example, the reference spectrum envelope contour G1_ref may be a spectrum envelope contour G1 at a freely-selected time point within the stationary period Q1.

Similarly, in Equation (3), the reference spectrum envelope contour G2_ref is a spectrum envelope contour G2 at a specific time point among the multiple spectrum envelope contours G2 of the second sound signal X2. Specifically, the reference spectrum envelope contour G2_ref is a spectrum envelope contour G2(Tm_R) at the synthesis start time Tm_R (an example of a second time point) of the second sound signal X2. That is, the reference spectrum envelope contour G2_ref is extracted at the start time T1_S of the stationary period Q1 or the start time T2_S of the stationary period Q2, whichever is later. It is of note that the reference spectrum envelope contour G2_ref may be extracted at a time point other than the synthesis start time Tm_R. For example, the reference spectrum envelope contour G2_ref may be a spectrum envelope contour G2 at a freely-selected time point within the stationary period Q1.

The coefficient μ1 and the coefficient μ2 in Equation (3) are each set to be as a non-negative value that is equal to or less than 1 ($0\leq\mu1\leq1$, $0\leq u2\leq1$). The second term of Equation (3) corresponds to a process of subtracting, from the spectrum envelope contour G1(t1) of the first sound signal X1, a difference between the spectrum envelope contour G1(t1) and the reference spectrum envelope contour G1_ref of the singing voice by a degree that accords with the coefficient μ1 (an example of a first coefficient). The third term of Equation (3) corresponds to a process of adding, to the spectrum envelope contour G1(t1) of the first sound signal X1, a difference between the spectrum envelope contour G2(t2) and the reference spectrum envelope contour G2_ref of the reference voice by a degree that accords with the coefficient μ2 (an example of a second coefficient). As will be understood from the above explanations, the release processor 32 calculates a synthesis spectrum envelope contour G(t) of the third sound signal Y by transforming the spectrum envelope contour G1(t1) according to the difference between the spectrum envelope contour G1(t1) and the reference spectrum envelope contour G1_ref of the singing voice (an example of a first difference) and the difference between the spectrum envelope contour G2(t2) and the reference spectrum envelope contour G2_ref of the reference voice (an example of a second difference). Specifically, the release processor 32 serves as an element that replaces the difference between the spectrum envelope contour G1(t1) and the reference spectrum envelope contour G1_ref of the singing voice (an example of the first difference) by the difference between the spectrum envelope contour G2(t2) and the reference spectrum envelope contour G2_ref of the reference voice (an example of the second difference). The above described Step S26 is an example of a "first process."

Attack Process S1

Figure 10:
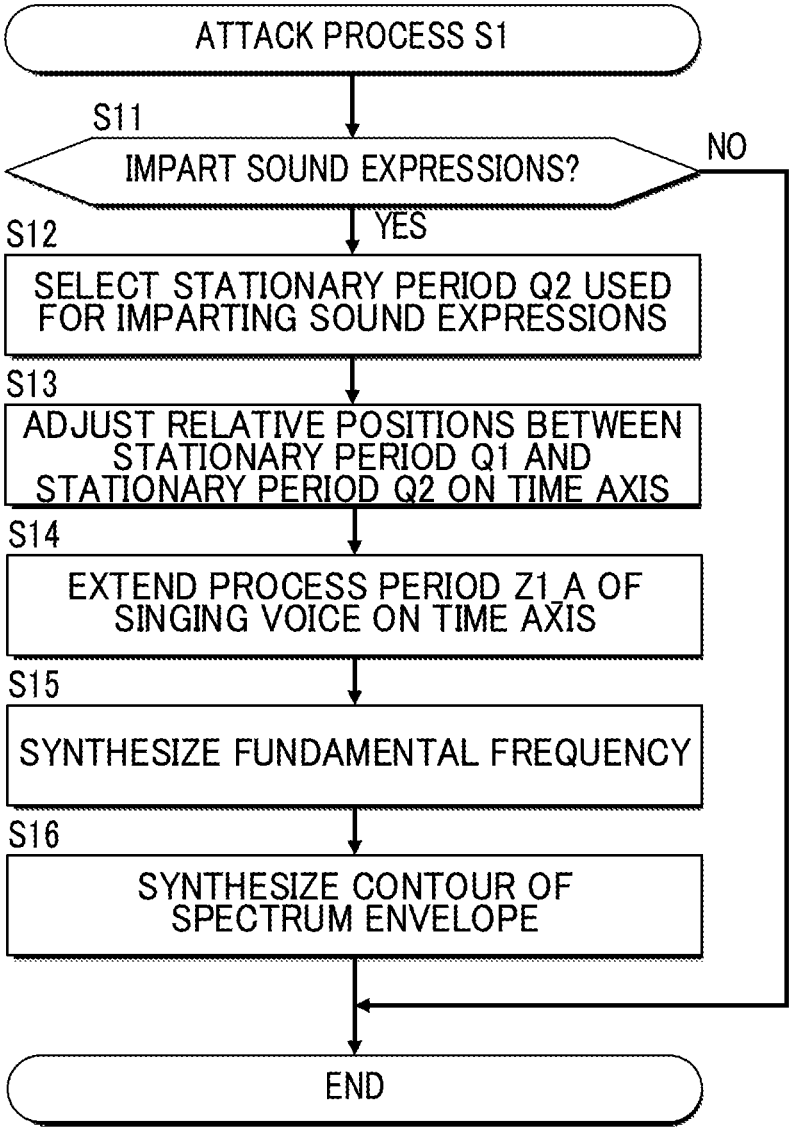
FIG. 10 is a flowchart illustrating specific procedures of an attack process.

FIG. 10 is a flowchart showing details of the attack process S1 performed by the attack processor 31. The attack process S1 shown in FIG. 10 is performed for each stationary period Q1 of the first sound signal X1. The specific procedure of the attack process S1 is the same as that of the release process S2.

When the attack process S1 starts, the attack processor 31 determines whether to impart sound expressions of an attack portion of a second sound signal X2 to a stationary period Q1 to be processed of the first sound signal X1 (S11). Specifically, the attack processor 31 determines not to impart sound expressions of an attack portion if the stationary period Q1 satisfies any one of the following conditions Ca1 to Ca5, for example. It is of note that the conditions for determining whether to impart sound expressions to the stationary period Q1 of the first sound signal X1 are not limited to the following examples.

Condition Ca1: a length of the stationary period Q1 is less than a predetermined value;

Condition Ca2: a range of variation in the fundamental frequency f1 smoothed within the stationary period Q1 exceeds a predetermined value;

Condition Ca3: a range of variation in the fundamental frequency f1 smoothed within a period of a predetermined length in the stationary period Q1 exceeds a predetermined value, the period including the start point of the stationary period Q1;

Condition Ca4: a length of a voiced period Va that immediately precedes the stationary period Q1 exceeds a predetermined value; and Condition Ca5: a range of variation in the fundamental frequency f1 of a voiced period Va that immediately precedes the stationary period Q1 exceeds a predetermined value.

Similarly to the above described Condition Cr1, Condition Ca1 takes into account a situation where it is difficult to impart sound expressions with natural voice features to a stationary period Q1 that is sufficiently short. Further, in a case that the fundamental frequency f1 changes greatly within a stationary period Q1, the singing voice is likely to have sufficient sound expressions imparted. Accordingly, if a range of variation in the smoothed fundamental frequency f1 of a stationary period Q1 exceeds a predetermined value, such a stationary period Q1 is excluded from those Q1 to which sound expressions are to be imparted (Condition Ca2). Condition Ca3 is substantially the same as Condition Ca2, but focuses on a period near the attack portion, in particular, of a stationary period Q1. Further, if a length of a voiced period Va that immediately precedes a stationary period Q1 is sufficiently long, or if the fundamental frequency f1 changes greatly within the voiced period Va, the singing voice is already likely to have sufficient sound expressions imparted. Accordingly, if a length of a voiced period Va that immediately precedes a stationary period Q1 exceeds a predetermined value (Condition Ca4), or if a range of variation in the fundamental frequency f1 of a voiced period Va that immediately precedes a stationary period Q1 exceeds a predetermined value (Condition Ca5), such a stationary period Q1 is excluded from those Q1 to which sound expressions are to be imparted. In a case where it is determined that sound expressions should not be imparted to the stationary period Q1 (S11: YES), the attack processor 31 ends the attack process S1 without executing the processes (S12-S16), which are described below in detail.

In a case where the attack processor 31 determines to impart sound expressions of an attack portion of the second sound signal X2 to the stationary period Q1 of the first sound signal X1 (S11: YES), the attack processor 31 selects a stationary period Q2 that corresponds to the sound expressions to be imparted to the stationary period Q1, from among the stationary periods Q2 of the second sound signal X2 (S12). The attack processor 31 selects the stationary period Q2 in the same manner as that when the release processor 32 selects a stationary period Q2.

Figure 11:
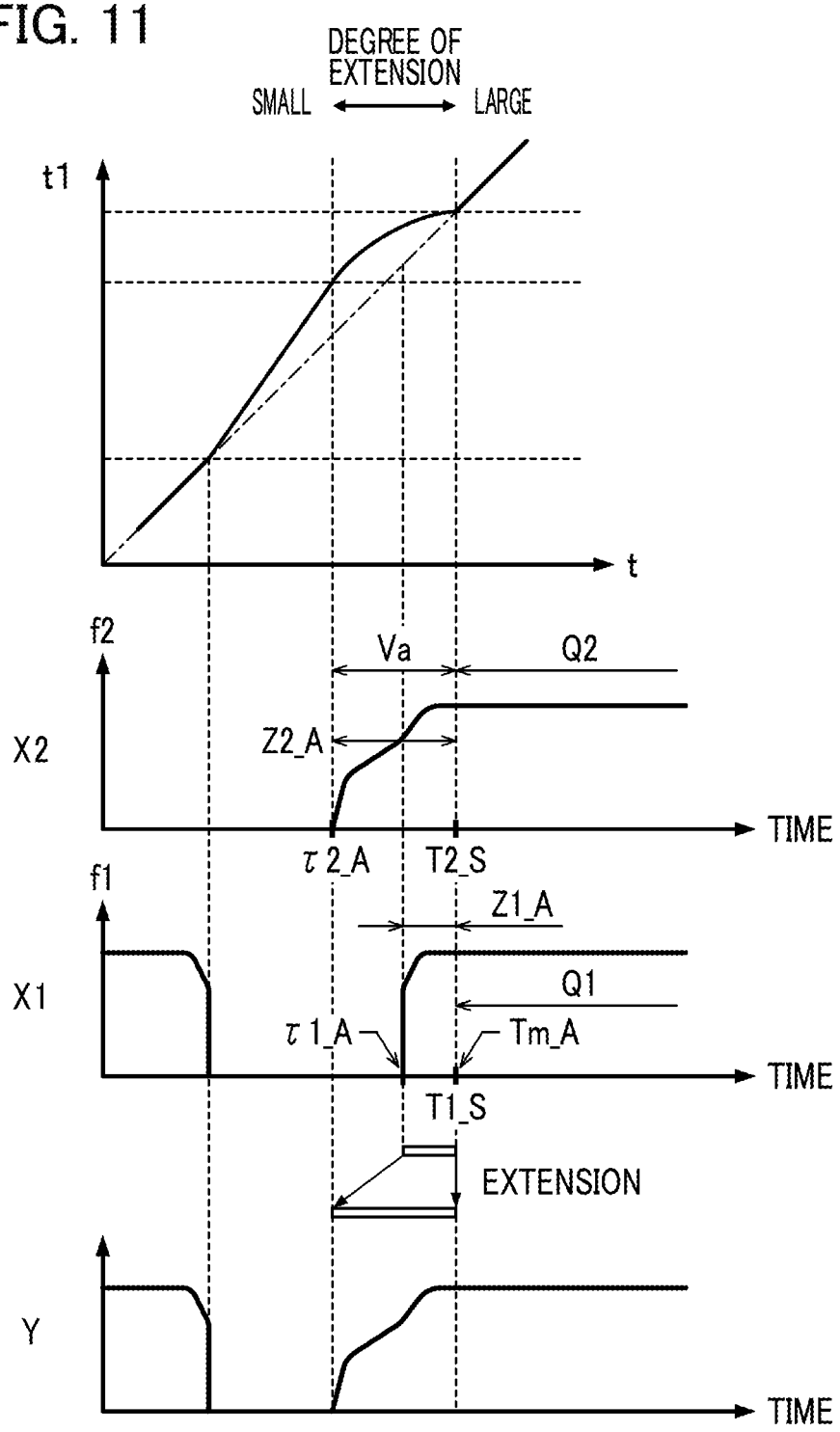
FIG. 11 is an explanatory diagram of the attack process.

The attack processor 31 executes the processes (S13-S16) for impartation of sound expressions of a stationary period Q2 selected by the above procedure to the first sound signal X1. FIG. 11 is an explanatory diagram of a process in which the attack processor 31 imparts the sound expressions of an attack portion to the first sound signal X1.

The attack processor 31 adjusts relative positions between the stationary period Q1 to be processed and the stationary period Q2 selected in Step S12 on a time axis (S13). Specifically, as shown in FIG. 11, the attack processor 31 determines a time axial position of the second sound signal X2 (stationary period Q2) relative to the first sound signal X1 such that the start time T2_S of the stationary period Q2 matches the start time T1_S of the stationary period Q1 on a time axis.

Extension of Process Period Z1_A

The attack processor 31 extends on a time axis of the first sound signal X1 a process period Z1_A to which sound expressions of the second sound signal X2 are to be imparted (S14). The process period Z1_A is from the start time $\tau$1_A of a voiced period Va that immediately precedes the stationary period Q1 until a time Tm_A at which the sound expression impartation ends (hereafter, "synthesis end time"). The synthesis end time Tm_A may be the start time T1_S of the stationary period Q1 (the start time T2_S of the stationary period Q2). Thus, the voiced period Va preceding the stationary period Q1 corresponds to the process period Z1_A and is extended in the attack process S1. As described above, the stationary period Q1 is a period corresponding to a note of a song. It is possible to avoid or reduce a likelihood of the start time T1_S of the stationary period Q1 from changing because the voiced period Va is extended but the stationary period Q1 is not extended in the above configuration. Thus, by use of the above configuration, it is possible to reduce a possibility of a note-on timing in the singing voice moving forward or backward.

As shown in FIG. 11, the attack processor 31 of the present embodiment extends the process period Z1_A of the first sound signal X1 dependent on a length of an expression period Z2_A in the second sound signal X2. The expression period Z2_A represents sound expressions of the attack portion in the second sound signal X2 and is used for imparting the sound expressions to the first sound signal X1. As shown in FIG. 11, the expression period Z2_A is a voiced period Va that immediately precedes the stationary period Q2.

Specifically, the attack processor 31 extends the process period Z1_A of the first sound signal X1 to match a length of the expression period Z2_A of the second sound signal X2. FIG. 11 shows a correspondence between the time t1 of the singing voice (vertical axis) and the time t of the transformed sound (horizontal axis).

As shown in FIG. 11, in the present embodiment the process period Z1_A is extended on the time axis such that the degree of extension is smaller closer to the start time τ1_A of the process period Z1_A. Therefore, the transformed sound can maintain sound characteristics of the singing voice that exist proximate to the start time τ1_A. On the other hand, the expression period Z2_A of the reference voice is neither extended nor contracted on a time axis. Accordingly, it is possible to impart to the first sound signal X1 sound expressions of an attack portion represented by the second sound signal X2 accurately.

After the process period Z1_A is extended by the above procedure, the attack processor 31 transforms in accordance with the expression period Z2_A of the second sound signal X2 the extended process period Z1_A of the first sound signal X1 (S15-S16). Specifically, fundamental frequencies in the extended process period Z1_A of the singing voice and those in the expression period Z2_A of the reference voice are synthesized together (S15), and a spectrum envelope contour in the extended process period Z1_R is synthesized with that in the expression period Z2_R (S16).

Specifically, the attack processor 31 performs the same computation as above in accordance with Equation (2), to calculate a fundamental frequency F(t) of the third sound signal Y from the fundamental frequency f1(t1) of the first sound signal X1 and the fundamental frequency F2(t2) of the second sound signal X2 (S15). The attack processor 31 subtracts from the fundamental frequency f1(t1) of the first sound signal X1 a difference between the fundamental frequency f1(t1) and the smoothed fundamental frequency F1(t1) of the singing voice by a degree that accords with the coefficient λ1, and adds to the fundamental frequency f1(t1) of the first sound signal X1 a difference between the fundamental frequency f2(t2) and the smoothed fundamental frequency F2(t2) of the reference voice by a degree that accords with the coefficient λ2. Accordingly, a temporal change in the fundamental frequency f1(t1) in the extended process period Z1_A of the first sound signal X1 approaches a temporal change in the fundamental frequency f2(t2) in the expression period Z2_A of the second sound signal X2.

The attack processor 31 synthesizes the spectrum envelope contour of the extended process period Z1_A of the singing voice with that in the expression period Z2_A of the reference voice (S16). Specifically, the attack processor 31 performs the same computation as above in accordance with Equation (3) to calculate a synthesis spectrum envelope contour G(t) of the third sound signal Y from the spectrum envelope contour G1(t1) of the first sound signal X1 and the spectrum envelope contour G2(t2) of the second sound signal X2. Step S16 as described above is an example of the "first process."

In the attack process S1, the reference spectrum envelope contour G1_ref applied to Equation (3) is a spectrum envelope contour G1(Tm_A) at a synthesis end time Tm_A (an example of the first time point) of the first sound signal X1. That is, the reference spectrum envelope contour G1_ref is extracted at the start time τ1_S of the stationary period Q1.

In the attack process S1, the reference spectrum envelope contour G2_ref applied to Equation (3) is a spectrum envelope contour G2(Tm_A) at a synthesis end time Tm_A (an example of the second time point) of the second sound signal X2. That is, the reference spectrum envelope contour G2_ref is extracted at the start time T1_S of the stationary period Q1.

As will be understood from the above explanations, each of the attack processor 31 and the release processor 32 in the present embodiment transforms the first sound signal X1(analysis data D1) using the second sound signal X2(analysis data D2) at a position on a time axis based on an end of the stationary period Q1 (the start time T1_S or the end time T1_E). By application of the above attack process S1 and the release process S2, there are generated a series of fundamental frequencies F(t) and a series of synthesis spectrum envelope contours G(t) of the third sound signal Y representative of a transformed sound. The voice synthesizer 33 in FIG. 2 generates a third sound signal Y using a series of fundamental frequencies F(t) and a series of synthesis spectrum envelope contours G(t) of the third signal Y. A process of generating the third sound signal Y by the voice synthesizer 33 is an example of a "second process".

The voice synthesizer 33 in FIG. 2 synthesizes the third sound signal Y representative of the transformed sound using the results from the attack process S1 and the release process S2 (i.e., transformed analysis data). Specifically, the voice synthesizer 33 adjusts each frequency spectrum g1 calculated from the first sound signal X1 to be aligned with the synthesis spectrum envelope contour G(t) and adjusts the fundamental frequency f1 to match the fundamental frequency F(t) of the first sound signal X1. The frequency spectrum g1 and the fundamental frequency f1 are adjusted for example in the frequency domain. The voice synthesizer 33 generates the third sound signal Y by converting the adjusted frequency spectrum as described above into a time domain signal.

As described, in the present embodiment the difference (G1(t1)−G1_ref) between the spectrum envelope contour G1(t1) and the reference spectrum envelope contour G1_ref of the first sound signal X1 and the difference (G2(t2)−G2_ref) between the spectrum envelope contour G2(t2) and the reference spectrum envelope contour G2_ref of the second sound signal X2 are synthesized with the spectrum envelope contour G1(t1) of the first sound signal X1. Accordingly, in the first sound signal X1 it is possible to generate a natural sounding transformed sound with continuous sound characteristics at boundaries between a period (the process period Z1_A or Z1_R) that is transformed using the second sound signal X2, and respective periods before and after the transformed period.

Further, in the present embodiment, in the first sound signal X1 there is specified a stationary period Q1 with a fundamental frequency f1 and a spectrum shape that are temporally stable, and the first sound signal X1 is transformed using the second sound signal X2 that is positioned based on an end (the start time τ1_S or the end time τ1_E) of the stationary period Q1.

Accordingly, an appropriate period of the first sound signal X1 is transformed in accordance with the second sound signal X2, whereby it is possible to generate a natural sounding transformed sound.

In the present embodiment, since a process period (Z1_A or Z1_R) of the first sound signal X1 is extended in accordance with a length of an expression period (Z2_A or Z2_R) of the second sound signal X2, there is no need to extend the second sound signal X2. Accordingly, sound characteristics (e.g., sound expressions) of the reference voice can be imparted to the first sound signal X1 accurately, while enabling generation of a natural sounding transformed sound.

Modifications

Specific modifications imparted to each of the above-described aspects are described below. Two or more modes selected from the following descriptions may be combined with one another as appropriate in so far as no contradiction arises.

(1) In the above embodiment the variation index Δ calculated from the first index δ1 and the second index δ2 is used to specify stationary periods Q1 in the first sound signal X1. However, stationary periods Q1 may be specified differently by use of the first index M and the second index δ2. For example, the signal analyzer 21 specifies a first provisional period in accordance with the first index δ1 and a second provisional period in accordance with the second index δ2. The first provisional period may be a period of a voice sound in which the first index δ1 is below a threshold. That is, a period in which the fundamental frequency f1 is temporally stable is specified as a first provisional period. The second provisional period may be a period of a voice sound in which the second index δ2 is below a threshold. That is, a period in which the spectrum shape is temporally stable is specified as a second provisional period. The signal analyzer 21 then specifies an overlapping period between the first provisional period and the second provisional period as a stationary period Q1. Thus, a period in which both the fundamental frequency f1 and the spectrum shape are temporally stable is specified as a stationary period Q1 in the first sound signal X1. As will be understood from the above explanations, the variation index Δ need not necessarily be calculated to specify a stationary period Q1. It is of note that although the above description focuses on the specification of stationary periods Q1, the same is true for the specification of stationary periods Q2 in the second sound signal X2.

(2) In the above embodiment a period in which both the fundamental frequency f1 and the spectrum shape are temporally stable is specified as a stationary period Q1 in the first sound signal X1. However, a period in which either the fundamental frequency f1 or the spectrum shape is temporally stable may be specified as a stationary period Q1 in the first sound signal X1. Similarly, a period in which either the fundamental frequency f2 or the spectrum shape is temporally stable may be specified as a stationary period Q2 in the first sound signal X2.

(3) In the above embodiment a spectrum envelope contour G1 at the synthesis start time Tm_R or the synthesis end time Tm_A in the first sound signal X1 is used as a reference spectrum envelope contour G1_ref. However, a time point (first time point) at which the reference spectrum envelope contour G1_ref is extracted is not limited thereto. For example, a spectrum envelope contour G1 at an end (the start time T1_S or the end time T1_E) of the stationary period Q1 may be the reference spectrum envelope contour G1_ref. It is of note that the first time point at which the reference spectrum envelope contour G1_ref is extracted is preferably a time point in a stationary period Q1 in which the spectrum shape is stable in the first sound signal X1.

The same applies to the reference spectrum envelope contour G2_ref. That is, in the above embodiment a spectrum envelope contour G2 at the synthesis start time Tm_R or the synthesis end time Tm_A in the second sound signal X2 is used as the reference spectrum envelope contour G2_ref. However, a time point (second time point) at which the reference spectrum envelope contour G2_ref is extracted is not limited thereto. For example, a spectrum envelope contour G2 at an end (the start time T2_S or the end time T2_E) of the stationary period Q2 may be the reference spectrum envelope contour G2_ref. It is of note that the second time point at which the reference spectrum envelope contour G2_ref is extracted is preferably a time point in a stationary period Q2 in which the spectrum shape is stable in the second sound signal X2.

Further, the first time point at which the reference spectrum envelope contour G1_ref is extracted in the first sound signal X1 and the second time point at which the reference spectrum envelope contour G2_ref is extracted in the second sound signal X2 may differ from each other on a time axis.

(4) In the above embodiment, processing is performed on the first sound signal X1 representative of a singing voice sung by a user of the sound processing apparatus 100. However, a voice represented by the first sound signal X1 is not limited to a singing voice sung by the user. For example, a voice synthesized by way of a sample concatenate-type or statistical model-type known voice synthesis technique may be used as the first sound signal X1 for processing by the sound processing apparatus 100. Further, the first sound signal X1 may be read out from a recording medium, such as an optical disk, for processing. Similarly, the second sound signal X2 may be obtained in a freely selected manner.

Further, a sound represented by the first sound signal X1 and the second sound signal X2 is not limited to a voice in a strict sense (i.e., a linguistic sound produced by a human). For example, the present disclosure may be applied in imparting various sound expressions (e.g., playing expressions) to a first sound signal X1 representative of a sound produced by playing a musical instrument. For example, playing expressions, such as vibrato in a second sound signal X2 may be imparted to a first sound signal X1 representative of a monotonous playing sound with no playing expressions.

(5) Functions of the sound processing apparatus 100 according to the above embodiment may be realized by at least one processor executing instructions (computer program) stored in a memory, as described above. The computer program may be provided in a form readable by a computer and stored in a recording medium, and installed in the computer. The recording medium is, for example, a non-transitory recording medium. While an optical recording medium (an optical disk) such as a CD-ROM (Compact disk read-only memory) is a preferred example of a recording medium, the recording medium may also include a recording medium of any known form, such as a semiconductor recording medium or a magnetic recording medium. The non-transitory recording medium includes any recording medium except for a transitory, propagating signal, and does not exclude a volatile recording medium. The non-transitory recording medium may be a storage apparatus in a distribution apparatus that stores a computer program for distribution via a communication network.

APPENDIX

The following configurations, for example, are derivable from the embodiments described above.

A sound processing method according to a preferred aspect (a first aspect) of the present disclosure obtains a first sound signal representative of a first sound, the first sound signal including a first spectrum envelope contour and a first reference spectrum envelope contour; obtains a second sound signal representative of a second sound differing in sound characteristics from the first sound, the second sound signal including a second spectrum envelope contour and a second reference spectrum envelope contour; generates a synthesis spectrum envelope contour by transforming the first spectrum envelope contour based on a first difference and a second difference; and generates a third sound signal representative of the first sound that has been transformed using the generated synthesis spectrum envelope contour. The first difference is present between the first spectrum envelope contour and the first reference spectrum envelope contour at a first time point of the first sound signal, and the second difference is present between the second spectrum envelope contour and the second reference spectrum envelope contour at a second time point of the second sound signal. In the above aspect, a synthesis spectrum envelope contour in a transformed sound is obtained by transforming a first sound according to a second sound. The synthesis spectrum envelope contour is generated by synthesizing the first difference and the second difference with the first spectrum envelope contour. The first difference is present between the first spectrum envelope contour and the first reference spectrum envelope contour of the first sound signal, and the second difference is present between the spectrum envelope contour and the second reference spectrum envelope contour of the second sound signal. Accordingly, it is possible to generate a natural sounding transformed sound in which sound characteristics are continuous at boundaries between a period of the first sound signal that is synthesized with the second sound signal and a period that precedes or follows the synthesized period. The spectrum envelope contour is a contour of a spectrum envelope. Specifically, the spectrum envelope contour is a representation of an intensity distribution obtained by smoothing the spectrum envelope to an extent that phonemic features (phoneme-dependent differences) and individual features (differences dependent on a person who produces a sound) can no longer be perceived. The spectrum envelope contour may be expressed in a form of a predetermined number of lower-order coefficients of multiple Mel Cepstrum coefficients representative of a contour of a frequency spectrum.

In a preferred example (a second aspect) of the first aspect, the method further adjusts a temporal position of the second sound signal relative to the first sound signal so that an end point of a first stationary period during which a spectrum shape is temporally stationary in the first sound signal matches an end point of a second stationary period during which a spectrum shape is temporally stationary in the second sound signal, the first time point is present in the first stationary period, and the second time point is present in the second stationary period, and the synthesis spectrum envelope contour is generated from the first sound signal and the adjusted second sound signal. In a preferred example (a third aspect) of the second aspect, each of the first time point and the second time point is a start point of the first stationary period or a start point of the second stationary period, whichever is later. In the above aspect, with the end point of the first stationary period matching that of the second stationary period, the start point of the first stationary period or the start point of the second stationary period, whichever is later, is selected as the first time point and the second time point. Accordingly, it is possible to generate a transformed sound in which sound characteristics of a release portion of the second sound are imparted to the first sound while maintaining continuity in sound characteristics at the start of each of the first stationary period and the second stationary period.

In a preferred example (a fourth aspect) of the first aspect, the method further adjusts a temporal position of the second sound signal relative to the first sound signal so that a start point of a first stationary period during which a spectrum shape is temporally stationary in the first sound signal matches a start point of a second stationary period during which a spectrum shape is temporally stationary in the second sound signal, and the first time point is present in the first stationary period, and the second time point is present in the second stationary period, and the synthesis spectrum envelope contour is generated from the first sound signal and the adjusted second sound signal. In a preferred example (a fifth aspect) of the fourth aspect, each of the first time point and the second time point is the start point of the first stationary period. In the above aspects, with the start point of the first stationary period matching that of the second stationary period, the start point of the first stationary period (the start point of the second stationary period) is selected as the first time point and the second time point. Accordingly, it is possible to generate a transformed sound in which sound characteristics around a sound producing point of the second sound are imparted to the first sound while avoiding or reducing a likelihood of the start of the first stationary period from changing.

In a preferred example (a sixth aspect) of any one of the second to fifth aspects, the first stationary period is specified based on a first index indicative of a degree of change in a fundamental frequency of the first sound signal and a second index indicative of a degree of change in the spectrum shape of the first sound signal. According to the above aspect, it is possible to determine a period in which both the fundamental frequency and the spectrum shape are temporally stable as a first stationary period. In some embodiments, a variation index may calculated based on the first index and the second index, and a first stationary period may be specified based on the variation index. In other embodiments, a first stationary period may be specified based on a first provisional period and a second provisional period after specifying the first provisional period based on the first index and the second provisional period based on the second index.

In a preferred example (a seventh aspect) of any one of the first to the sixth aspects, the generating of the synthesis spectrum envelope contour includes subtracting a result obtained by multiplying the first difference by a first coefficient from the first spectrum envelope contour and adding to the first spectrum envelope contour a result obtained by multiplying the second difference by a second coefficient. In the above aspect, a series of synthesis spectrum envelope contours is generated by subtracting a result obtained by multiplying the first difference by the first coefficient from the first spectrum envelope contour and adding to the first spectrum envelope contour a result obtained by multiplying the second difference by the second coefficient. Thus, it is possible to generate a transformed sound in which sound expressions of the first sound are reduced, and sound expressions of the second sound are imparted to good effect.

In a preferred example (an eighth aspect) of any one of the first to the seventh aspects, the generating of the synthesis spectrum envelope contour includes: extending a process period of the first sound signal according to a length of an expression period of the second sound signal, for application in transforming the first sound signal; and generating the synthesis spectrum envelope contour by transforming the first spectrum envelope contour in the extended process period based on the first difference in the extended process period and the second difference in the expression period.

A sound processing apparatus according to a preferred aspect (a ninth aspect) of the present disclosure includes a memory storing instructions; and at least one processor that implements the instructions to: obtain a first sound signal representative of a first sound, the first sound signal including a first spectrum envelope contour and a first reference spectrum envelope contour; obtain a second sound signal representative of a second sound differing in sound characteristics from the first sound, the second sound signal including a second spectrum envelope contour and a second reference spectrum envelope contour; generate a synthesis spectrum envelope contour by transforming the first spectrum envelope contour based on a first difference and a second difference; and generate a third sound signal representative of the first sound that has been transformed using the generated synthesis spectrum envelope contour. The first difference is present between the first spectrum envelope contour and the first reference spectrum envelope contour at a first time point of the first sound signal, and the second difference is present between the second spectrum envelope contour and the second reference spectrum envelope contour at a second time point of the second sound signal.

In a preferred example (a tenth aspect) of the ninth aspect, the at least one processor implements the instructions to adjust a temporal position of the second sound signal relative to the first sound signal so that an end point of a first stationary period during which a spectrum shape is temporally stationary in the first sound signal matches an end point of a second stationary period during which a spectrum shape is temporally stationary in the second sound signal, the first time point is present in the first stationary period, and the second time point is present in the second stationary period, and the synthesis spectrum envelope contour is generated from the first sound signal and the adjusted second sound signal. In a preferred example (an eleventh aspect) of the tenth aspect, each of the first time point and the second time point is a start point of the first stationary period or a start point of the second stationary period, whichever is later.

In a preferred example (a twelfth aspect) of the ninth aspect, the at least one processor implements the instructions to adjust a temporal position of the second sound signal relative to the first sound signal so that a start point of a first stationary period during which a spectrum shape is temporally stationary in the first sound signal matches a start point of a second stationary period during which a spectrum shape is temporally stationary in the second sound signal, the first time point is present in the first stationary period, and the second time point is present in the second stationary period, and the synthesis spectrum envelope contour is generated from the first sound signal and the adjusted second sound signal. In a preferred example (a thirteenth aspect) of the twelfth aspect, each of the first time point and the second time point is the start point of the first stationary period.

In a preferred example (a fourteenth aspect) of any one of the ninth to thirteenth aspects, the at least one processor is configured to subtract a result obtained by multiplying the first difference by a first coefficient from the first spectrum envelope contour and adding to the first spectrum envelope contour a result obtained by multiplying the second difference by a second coefficient.

A non-transitory computer-readable recording medium according to a preferred aspect (a fifteenth aspect) of the present disclosure stores a program executable by a computer to execute a sound processing method comprising: obtaining a first sound signal representative of a first sound, the first sound signal including a first spectrum envelope contour and a first reference spectrum envelope contour; obtaining a second sound signal representative of a second sound differing in sound characteristics from the first sound, the second sound signal including a second spectrum envelope contour and a second reference spectrum envelope contour; generating a synthesis spectrum envelope contour by transforming the first spectrum envelope contour based on a first difference and a second difference; and generating a third sound signal representative of the first sound that has been transformed using the generated synthesis spectrum envelope contour. The first difference is present between the first spectrum envelope contour and the first reference spectrum envelope contour at a first time point of the first sound signal, and the second difference is present between a second spectrum envelope contour and the second reference spectrum envelope contour at a second time point of the second sound signal.

BRIEF DESCRIPTION OF REFERENCE SIGNS

100 . . . sound processing apparatus, 11 . . . controller, 12 . . . storage device, 13 . . . input device, 14 . . . sound output device, 21 . . . signal analyzer, 22 . . . synthesis processor, 31 . . . attack processor, 32 . . . release processor, 33 . . . voice synthesizer

What is claimed is:

1. A computer-implemented sound processing method comprising:

obtaining a first sound signal representative of a first sound, the first sound signal including a first spectrum envelope contour and a first reference spectrum envelope contour;

obtaining a second sound signal representative of a second sound differing in sound characteristics from the first sound, the second sound signal including a second spectrum envelope contour and a second reference spectrum envelope contour;

generating a synthesis spectrum envelope contour by transforming the first spectrum envelope contour based on a first difference and a second difference, wherein:

the first difference is present between the first spectrum envelope contour and the first reference spectrum envelope contour at a first time point of the first sound signal present in a first stationary period during which a spectrum shape is temporally stationary in the first sound signal; and the second difference is present between the second spectrum envelope contour and the second reference spectrum envelope contour at a second time point of the second sound signal present in a second stationary period during which a spectrum shape is temporally stationary in the second sound signal; and generating a third sound signal representative of the first sound that has been transformed using the generated synthesis spectrum envelope contour.

2. The sound processing method according to claim 1, further comprising:

adjusting a temporal position of the second sound signal relative to the first sound signal so that an end point of the first stationary period matches an end point of the second stationary period, and wherein the synthesis spectrum envelope contour is generated from the first sound signal and the adjusted second sound signal.

3. The sound processing method according to claim 2, wherein each of the first time point and the second time point is a start point of the first stationary period or a start point of the second stationary period, whichever is later.

4. The sound processing method according to claim 1, further comprising:

adjusting a temporal position of the second sound signal relative to the first sound signal so that a start point of the first stationary period matches a start point of the second stationary period during, and wherein the synthesis spectrum envelope contour is generated from the first sound signal and the adjusted second sound signal.

5. The sound processing method according to claim 4, wherein each of the first time point and the second time point matches the start point of the first stationary period.

6. The sound processing method according to claim 2, wherein the first stationary period is specified based on a first index indicative of a degree of change in a fundamental frequency of the first sound signal and a second index indicative of a degree of change in the spectrum shape of the first sound signal.

7. The sound processing method according to claim 1, wherein the generating of the synthesis spectrum envelope contour includes subtracting a result obtained by multiplying the first difference by a first coefficient from the first spectrum envelope contour and adding to the first spectrum envelope contour a result obtained by multiplying the second difference by a second coefficient.

8. The sound processing method according to claim 1, wherein the generating of the synthesis spectrum envelope contour includes:

extending a process period of the first sound signal according to a length of an expression period of the second sound signal, for application in transforming the first sound signal; and generating the synthesis spectrum envelope contour by transforming the first spectrum envelope contour in the extended process period based on the first difference in the extended process period and the second difference in the expression period.

9. A sound processing apparatus comprising:

a memory storing instructions; and at least one processor that implements the instructions to:

obtain a first sound signal representative of a first sound, the first sound signal including a first spectrum envelope contour and a first reference spectrum envelope contour;

obtain a second sound signal representative of a second sound differing in sound characteristics from the first sound, the second sound signal including a second spectrum envelope contour and a second reference spectrum envelope contour;

generate a synthesis spectrum envelope contour by transforming the first spectrum envelope contour based on a first difference and a second difference, wherein:

the first difference is present between the first spectrum envelope contour and the first reference spectrum envelope contour at a first time point of the first sound signal present in a first stationary period during which a spectrum shape is temporally stationary in the first sound signal; and the second difference is present between the second spectrum envelope contour and the second reference spectrum envelope contour at a second time point of the second sound signal present in a second stationary period during which a spectrum shape is temporally stationary in the second sound signal; and generate a third sound signal representative of the first sound that has been transformed using the generated synthesis spectrum envelope contour.

10. The sound processing apparatus according to claim 9, wherein:

the at least one processor implements the instructions to adjust a temporal position of the second sound signal relative to the first sound signal so that an end point of the first stationary period matches an end point of the second stationary period, and the synthesis spectrum envelope contour is generated from the first sound signal and the adjusted second sound signal.

11. The sound processing apparatus according to claim 10, wherein each of the first time point and the second time point is a start point of the first stationary period or a start point of the second stationary period, whichever is later.

12. The sound processing apparatus according to claim 9, wherein:

the at least one processor implements the instructions to adjust a temporal position of the second sound signal relative to the first sound signal so that a start point of the first stationary period matches a start point of the second stationary period, and the synthesis spectrum envelope contour is generated from the first sound signal and the adjusted second sound signal.

13. The sound processing apparatus according to claim 12, wherein each of the first time point and the second time point matches the start point of the first stationary period.

14. The sound processing apparatus according to claim 9, wherein the at least one processor is configured to subtract a result obtained by multiplying the first difference by a first coefficient from the first spectrum envelope contour and adding to the first spectrum envelope contour a result obtained by multiplying the second difference by a second coefficient.

15. A non-transitory computer-readable recording medium storing a program executable by a computer to execute a sound processing method comprising:

obtaining a first sound signal representative of a first sound, the first sound signal including a first spectrum envelope contour and a first reference spectrum envelope contour;

obtaining a second sound signal representative of a second sound differing in sound characteristics from the first sound, the second sound signal including a second spectrum envelope contour and a second reference spectrum envelope contour;

generating a synthesis spectrum envelope contour by transforming the first spectrum envelope contour based on a first difference and a second difference, wherein:

the first difference is present between the first spectrum envelope contour and the first reference spectrum envelope contour at a first time point of the first sound signal present in a first stationary period during which a spectrum shape is temporally stationary in the first sound signal; and the second difference is present between a second spectrum envelope contour and the second reference spectrum envelope contour at a second time point of the second sound signal present in a second stationary period during which a spectrum shape is temporally stationary in the second sound signal; and generating a third sound signal representative of the first sound that has been transformed using the generated synthesis spectrum envelope contour.

* * * * *